United States Patent [19]

Walker

[11] 4,335,537

[45] Jun. 22, 1982

[54] TOY AIRCRAFT

[75] Inventor: Terence J. Walker, Naremburn, Australia

[73] Assignee: Plectrum Pty. Limited, Naremburn, Australia

[21] Appl. No.: 208,108

[22] Filed: Nov. 18, 1980

[30] Foreign Application Priority Data

Nov. 28, 1979 [AU] Australia ..... PE1510

[51] Int. Cl.[3] ..... A63H 27/00

[52] U.S. Cl. ..... 46/79; 46/82; 244/7 A; 244/8; 273/428

[58] Field of Search ..... 46/79, 78, 75, 83, 74 D, 46/84, 74 R, 85, 76 R, 82; 273/426, 428, 424, 425; 244/17.11, 12.2, 6, 7 R, 7 A, 8, 10

[56] References Cited

U.S. PATENT DOCUMENTS 2,035,629 3/1936 Wing ..... 273/426 X 2,717,131 9/1955 Barrett ..... 244/6

*Primary Examiner*—Robert Peshock

*Assistant Examiner*—Mickey Yu

*Attorney, Agent, or Firm*—Ladas & Parry

[57] ABSTRACT

A toy aircraft having a rotatable wing assembly having at least two blades of aerofoil cross-section extending radially outwardly from the axis of rotation of the assembly, each blade having a zero pitch angle so that in operation the blades have a negative pitch angle relative to the airstream.

3 Claims, 7 Drawing Figures

TOY AIRCRAFT

The present invention relates to toys and more particularly to toy aircraft.

There is disclosed herein an aircraft including a body with control surfaces to be engaged by an air stream moving over the surfaces to stabilize and control the aircraft, and a rotatable wing assembly, said assembly having at least two blades of aerofoil cross-section extending radially outwardly from the axis of rotation of the assembly, and whereas said blades have a zero pitch angle so that in operation the blades have a negative pitch angle relative with respect to the air stream.

In one preferred form the assembly includes three blades spaced at 120° intervals around the axis of the assembly.

Preferred forms of the present invention will now be described by way of example with reference to the accompanying drawings, wherein.

Figure 1:
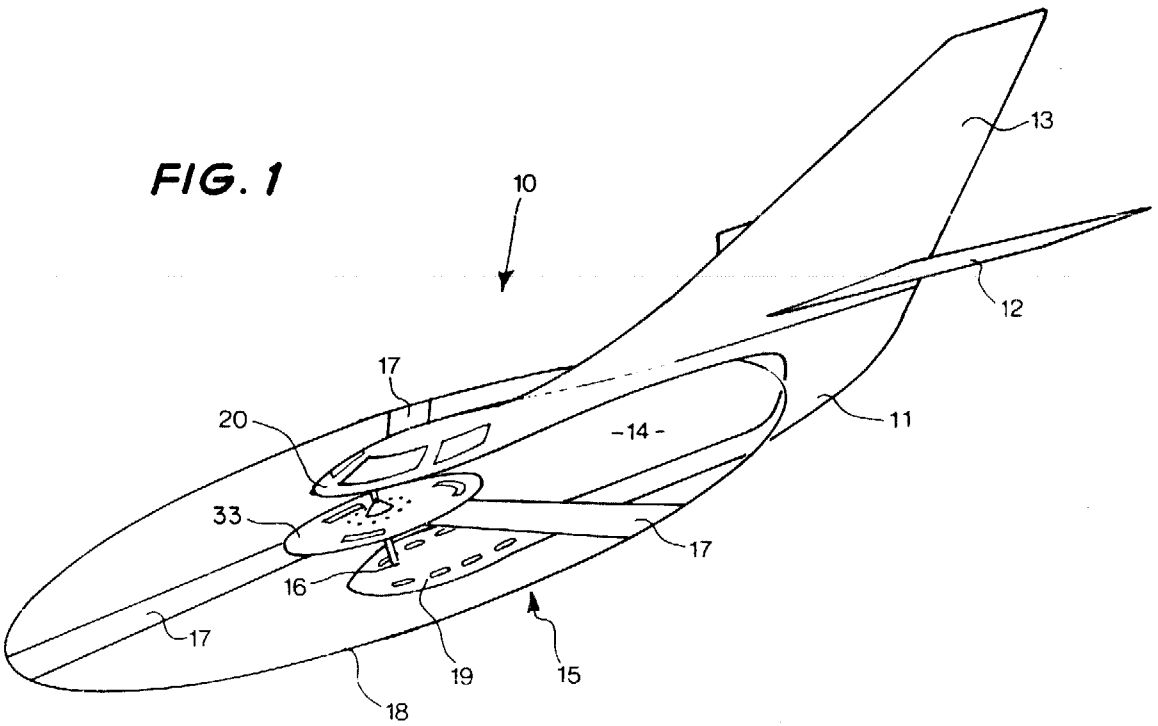
FIG. 1 is a schematic perspective view of a toy aircraft.

Firstly, with reference to the embodiment of FIGS. 1 to 5, there is illustrated a toy aireraft 10 which has a body 11 with rear horizontal control surfaces 12 and a vertical control surface 13. The body has a forward U-shaped portion defining a recess 14 within which is located a rotatable blade assembly 15. The blade assembly 15 includes an axle 16 about which the blade assembly 15 rotates. The blade assembly 15 further includes three blades 17 spaced 120° intervals around the axis of the axle 16 and extend radially from a central hub 33 so as to be located generally within a common plane. The blades 17 are of an aerofoil cross-section and have a zero pitch angle so that in use the blades have a negative angle of incidence relative to an air stream through which the aircraft 10 is falling. Joining the ends of the blades 17 is a protective strip 18.

The blade assembly 15, body 11 and control surfaces 12 and 13 are configured so that a user of the toy may grip one of the blades 17 adjacent its extremity and throw the aircraft 10 into the air while flicking the gripped blade to cause rotation of the blade assembly 15 thus causing air to pass thereover. Air movement of the blades 17 will give the aircraft lift causing it to rise. Upon the assembly 15 losing its initial rotational momentum the aircraft will begin to fall, however, the rate of decline will be controlled since as the aircraft falls air will again pass over the blade 17 causing the continuance of rotation and thus maintenance of a reduced lift force. Thus the aircraft will glide gently to ground in a controlled manner. Additionally, since the blades 17 rotate about the axle 16 the lift force on the blades will not be symmetrical about the longitudinal axis of the aircraft 10 thus causing the aircraft 10 to turn in flight and ideally return to the user. The aircraft 10 may be thrown so that the blades 17 extend in a generally vertical or horizontal plane.

In addition to the blades 17 providing lift the lower 19 and upper 20 parts of the U-shaped portion may be of an aerofoil cross-section to also provide lift.

Figure 6:
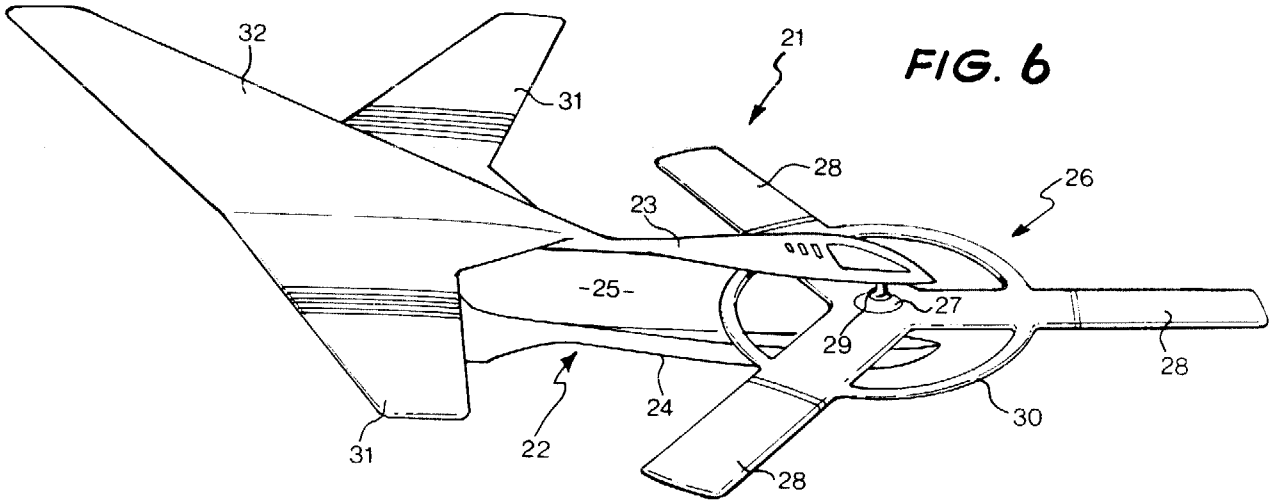
FIG. 6 is a schematic perspective view of another toy aircraft.
Figure 7:
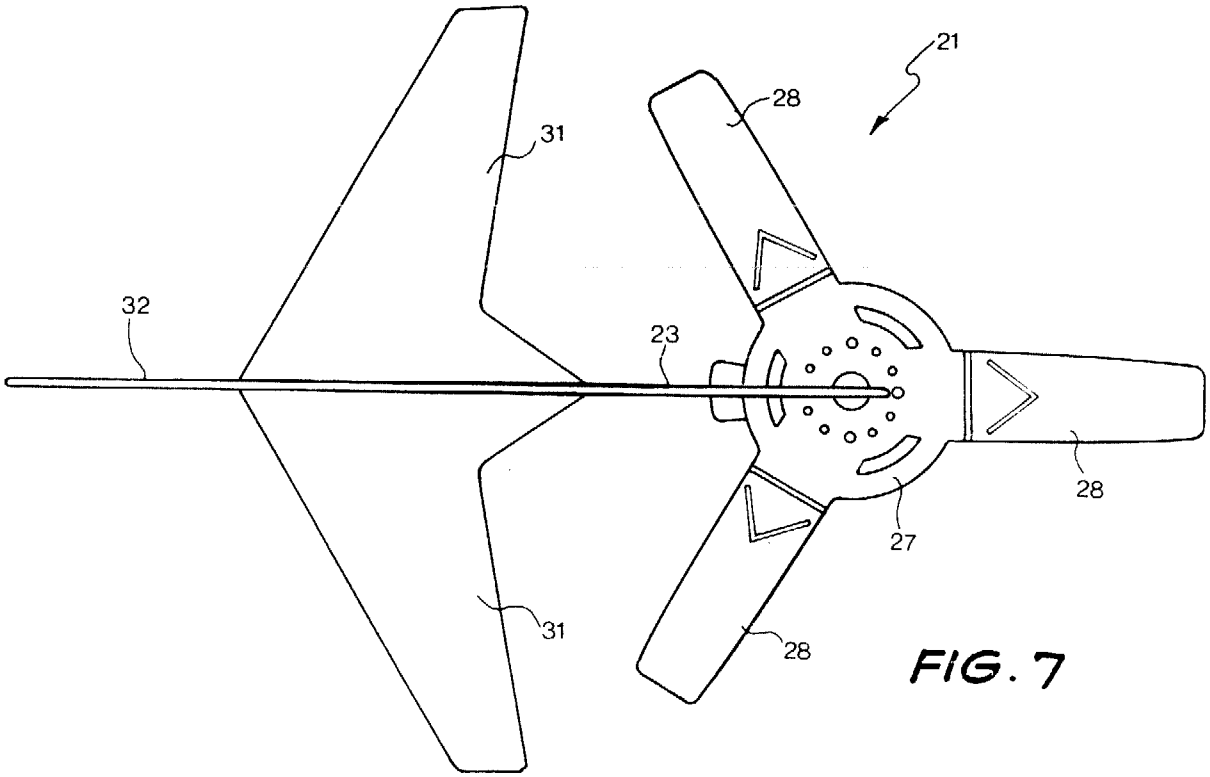
FIG. 7 is a plan view of the aircraft of FIG. 6.

Now with reference to the embodiment depicted in FIGS. 6 and 7, the toy aircraft comprises a body 22 consisting of an upper portion 23 and a lower portion 24 which define a generally U-shaped recess 25 within which there is received a rotatable wing assembly 26. The wing assembly 26 consists of a three blade structure having a central hub 27 from which radially extends three blades 28 which are spaced by 120° about the hub 27. Extending through the hub 27 is an axle 29 which rotatably supports the rotating wing assembly 28 and is attached to the upper and lower portions 23 and 24. The blades 28 extend generally within a common plane and are joined by a reinforcing ring 30.

Turning now to the rear of the toy aircraft 21, the control surfaces include two transversely extending wings 31 which project slightly forward while there is also provided a rear vertical control wing 32 which extends generally rearward. This preferred embodiment provides a toy aircraft similar to that depicted in FIG. 1 and it is intended that the aircraft of this embodiment be operated as described with reference to the toy aircraft of FIG. 1.

Figure 2:
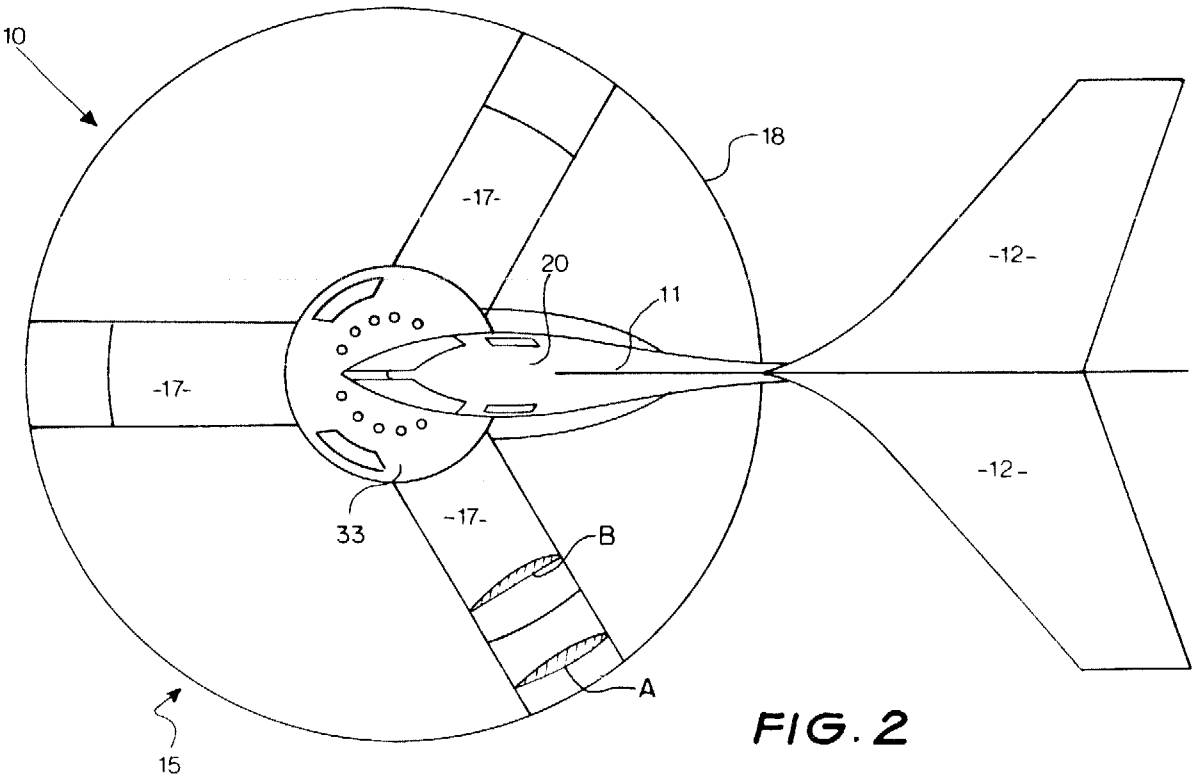
FIG. 2 is a top plan view of the aircraft of FIG. 1.
Figure 3:
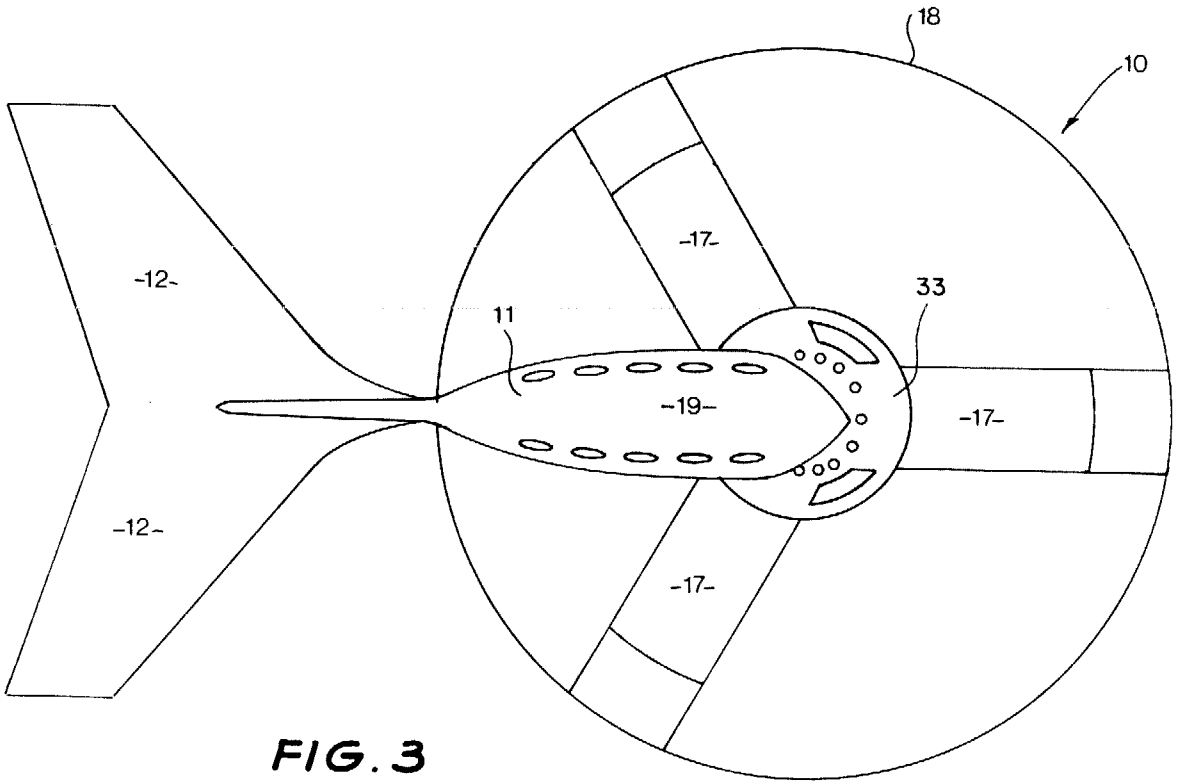
FIG. 3 is a bottom plan view of the aircraft of FIG. 1.
Figure 4:
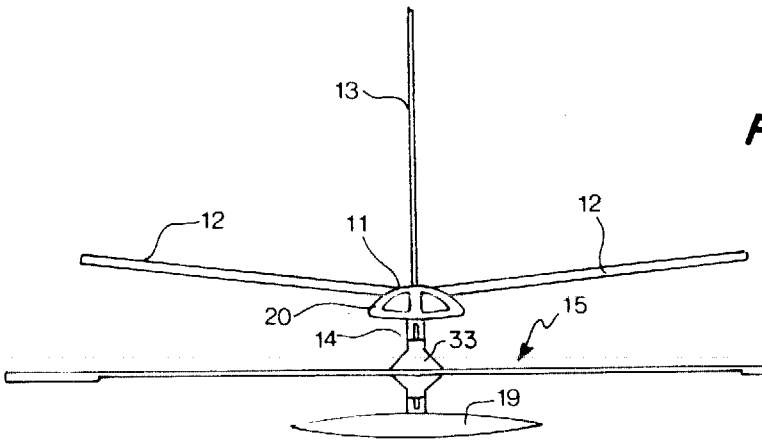
FIG. 4 is a front elevation of the aircraft of FIG. 1.
Figure 5:
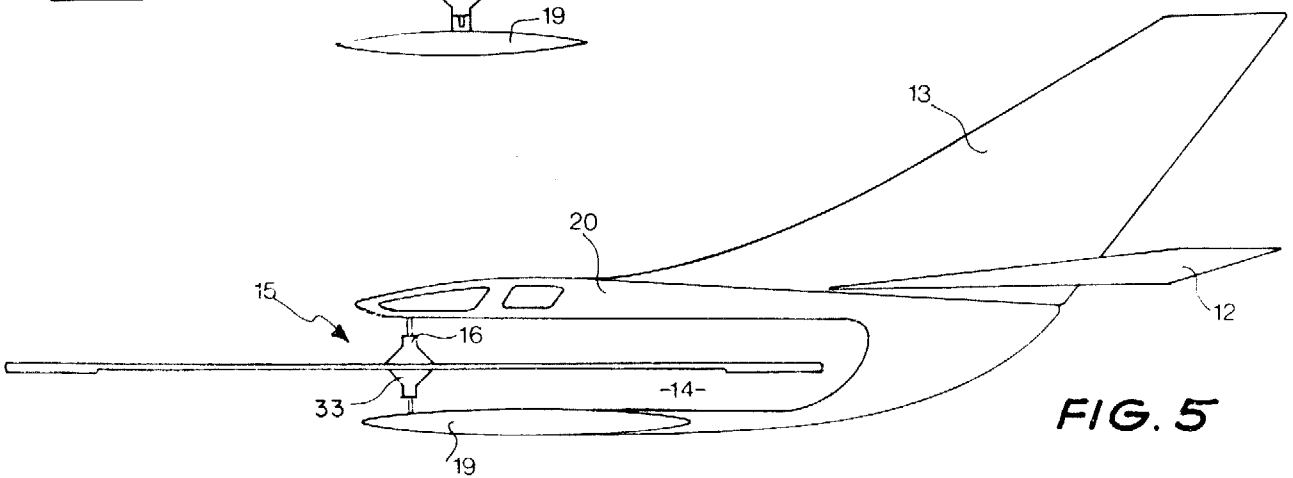
FIG. 5 is a side elevation of the aircraft of FIG. 1.

Turning again to the embodiment of FIG. 1 and more particularly as depicted in FIG. 2, it is preferable that each of the blades of the wing assemblies be constructed so as to have an aerofoil cross-section which is fully symmetrical about a transverse axis of the blade (as illustrated by the section A). It is further preferred that each wing have an inner portion consisting of a half aerofoil cross-section as illustrated by the section B, and an outer portion having a full aerofoil cross-section as illustrated by the section A.

What I claim is:

1. A toy aircraft comprising a body having a forward and rearward portion, said forward portion having a generally U-shaped configuration so as to provide two forwardly horizontally extending legs defining a forwardly open recess with one of the legs being vertically beneath the other; horizontal and vertical control surfaces attached to the body at said rear portion to stabilize and control the aircraft as it moves through the air; and a rotatable wing assembly for rotation about an axis and to pass through said recess, said assembly including a shaft extending between said legs so as to be supported thereby and being located on said axis, a plurality of blades extending radially outwardly from said shaft at predetermined angular positions thereabout while being rotatably supported thereby.

2. The aircraft of claim 1 wherein said blades have a zero pitch angle.

3. The aircraft of claim 1 or 2 wherein said wing assembly includes three blades located in a common plane and spaced by 120° about said axis.

* * * * *